US007246453B2

(12) United States Patent
Kim

(10) Patent No.: US 7,246,453 B2
(45) Date of Patent: Jul. 24, 2007

(54) SOLE FOR BOWLING SHOES

(76) Inventor: Bong-Ho Kim, 102-1404, Asia Sunsuchon APT Banyeo 1-Dong, Haeundae-Gu, Busan (KR)

( * ) Notice: Subject to any disclaimer, the term of this patent is extended or adjusted under 35 U.S.C. 154(b) by 270 days.

(21) Appl. No.: 10/982,208

(22) Filed: Nov. 5, 2004

(65) Prior Publication Data

US 2006/0021260 A1 Feb. 2, 2006

(30) Foreign Application Priority Data

Jul. 27, 2004 (KR) ..... 20-2004-0021393 U

(51) Int. Cl.
*A43B 5/00* (2006.01)
*A43C 13/00* (2006.01)

(52) U.S. Cl. ..... 36/15; 36/100; 36/130

(58) Field of Classification Search ..... 36/15, 36/100, 101, 130
See application file for complete search history.

(56) References Cited

U.S. PATENT DOCUMENTS 2,183,277 A * 12/1939 Heilhecker ..... 36/14
2,640,283 A * 6/1953 McCord ..... 36/25 R
3,027,661 A * 4/1962 McCord ..... 36/30 R
3,538,628 A * 11/1970 Einstein, Jr. ..... 36/15
4,267,650 A * 5/1981 Bauer ..... 36/101
4,317,294 A * 3/1982 Goodyear ..... 36/100
4,377,042 A * 3/1983 Bauer ..... 36/101
4,887,369 A * 12/1989 Bailey et al. ..... 36/101
5,317,822 A * 6/1994 Johnson ..... 36/101
5,533,280 A * 7/1996 Halliday ..... 36/101
5,542,198 A * 8/1996 Famolare ..... 36/130
6,243,973 B1 * 6/2001 Lind ..... 36/130
6,389,712 B1 * 5/2002 Schelling ..... 36/15
6,813,847 B2 * 11/2004 Workman ..... 36/15

* cited by examiner

*Primary Examiner*—Marie Patterson
(74) *Attorney, Agent, or Firm*—Tuchman & Park LLC

(57) ABSTRACT

The present invention discloses a sole for bowling shoes in which a slip plate is detachably attached at the front portion of a bottom face thereof and a heel part is detachably attached at the back portion of the bottom face thereof, the sole for bowling shoes comprising: a fixing plate having a protecting rim formed integrally therewith along the outside edge of each of the front and back portions of the bottom face, the fixing plate having a coupling groove formed at the inside of the protecting rim; and a separating plate fixedly attached at the slip plate and the heel part, respectively, the separating plate having a coupling protrusion formed correspondingly to the coupling groove of the fixing plate.

5 Claims, 9 Drawing Sheets

SOLE FOR BOWLING SHOES

This application claims priority from pending Korean Patent Application No. 2004-21393 filed on Jul. 27, 2004.

FIELD OF THE INVENTION

The present invention relates to a sole for bowling shoes that is provided with a bottom face that can be selectively exchanged in accordance with the features of various bowling lanes, and more particularly, to a sole for bowling shoes that is capable of detachably attaching a slip plate and a heel part to a bottom face on the sole in simple and rigid manners.

BACKGROUND OF THE RELATED ART

Bowling is a game in which a player rolls down a ball along a narrow lane towards a group of pins for the purpose of knocking down more pins than an opponent. In the game, steps are very important and therefore, beginner should initially learn the steps accurately. Generally, there are three types of steps such as three-step, four-step, and five-step types.

At this time, a player chooses such the steps as adequate to his or her physical conditions, and at his or her last step, when his or her left foot is moved forwardly and his or her weight is sent to the left foot, a sliding motion should be carried out at the left foot. On the other hand, his or her right foot that is positioned at a rear side should have a non-slip function in order to roll down the ball at a more stable posture.

Thus, there have been proposed a variety of types of bowling shoes that conform to the characteristics of bowling, and right and left soles are designed differently from each other in the shapes of the slip parts thereof such that the left sole associated with the last step can easily slips on the lane.

As shown in FIG. 1, a sole 1 for a left bowling shoe is provided with a slip plate 3 that is placed at the front portion of a bottom face 2 thereof, a heel part 4 that is placed at the back portion of the bottom face 2, and fixing means 5 like a Velcro-fastener that detachably fixes the slip plate 3 and the heel part 4 thereto in their positions. In accordance with the features of the lane, thus, the slip plate 3 and the heel part 4 are respectively exchanged for another.

According to the conventional sole 1 for bowling shoes as constructed above, the slip plate 3 and the heel part 4 are attached at the front and back portions of the bottom face 2, thereby making it difficult to attach them on the bottom face 2 in their right positions. Also, the slip plate 3 may be worn out along the outside edge thereof, thereby making the usage term substantially short, and the heel part 4 is protrudedly attached outwardly from the bottom face 2, such that it may be easily separated from the bottom face 2 when external impacts are applied thereto.

To solve the above-mentioned problems, as shown in FIG. 2, there is provided another conventional sole 1 for bowling shoes having a slip plate 3 placed at the front portion of a bottom face 2, a heel part 4 placed at the back portion of the bottom face 2, and fixing means 5 like a Velcro-fastener for detachably fixing the slip plate 3 and the heel part 4 in their positions, the sole 1 for bowling shoes including: a protecting rim 6 disposed along the outside edge of the front portion of the bottom face 2 for protecting the slip plate 3 attached at the inside thereof, the protecting rim having the same thickness as the slip plate 3; and a coupling protrusion 7 formed at the back portion of the bottom face 2 for coupling with a coupling hole 8 formed at a position of the heel part 4 corresponding to the coupling protrusion 7. Such the conventional example is disclosed in Korean Utility Model Registration No. 20-0341117.

According to the above-mentioned prior arts, however, the fixing means 5 like Velcro-fastener is used to fix the slip plate 3 and the heel part 4, such that at the time of assembling and disassembling the slip plate 3 and the heel part 4 to and from their positions, foreign substances like dust become stick to the fixing means 5, which makes the fixing force gradually weakened. Also, the fixing means 5 like Velcro-fastener should be attached not only at the front and back portions of the bottom face 2 but also at the slip plate 3 and the heel part 4 disposed at the positions corresponding to them, which makes the production costs substantially high and also causing the working efficiency to be low.

SUMMARY OF THE INVENTION

Accordingly, the present inventor has been made to solve the above-described problems, and it is an object of the present invention to provide a sole for bowing shoes that is provided with a fixing plate that is fixedly disposed at a bottom face thereof and has a coupling groove formed along the outer edge of each of the front and back portions of the bottom face thereof and with a separating plate that is detachably attached at a slip plate and a heel part, respectively and has a coupling protrusion formed correspondingly to the coupling groove, such that when the coupling protrusion is fit into the coupling groove, the coupling of the bottom face with the slip plate and the heel part is simply made, while exhibiting a substantially high coupling force, and as the manufacturing and assembling processes of the constructing members are simply carried out, the productivity efficiency is improved and the manufacturing costs are reduced.

To accomplish the above object, according to the present invention, there is provided a sole for bowling shoes in which a slip plate is detachably attached at the front portion of a bottom face thereof and a heel part is detachably attached at the back portion of the bottom face thereof, the sole for bowling shoes including: a fixing plate having a protecting rim formed integrally with the fixing plate along the outside edge of each of the front and back portions of the bottom face, the fixing plate having a coupling groove formed at the inside of the protecting rim; and a separating plate detachably fixed at the slip plate and the heel part, respectively, the separating plate having a coupling protrusion formed correspondingly to the coupling groove of the fixing plate.

BRIEF DESCRIPTION OF DRAWINGS

The above and other objects, features and advantages of the present invention will be apparent from the following detailed description of the preferred embodiments of the invention in conjunction with the accompanying drawings, in which.

DETAILED DESCRIPTION OF PREFERRED EMBODIMENTS

Now, an explanation on the preferred embodiments of the present invention will be in detail given with reference to the attached drawings.

Figure 1:
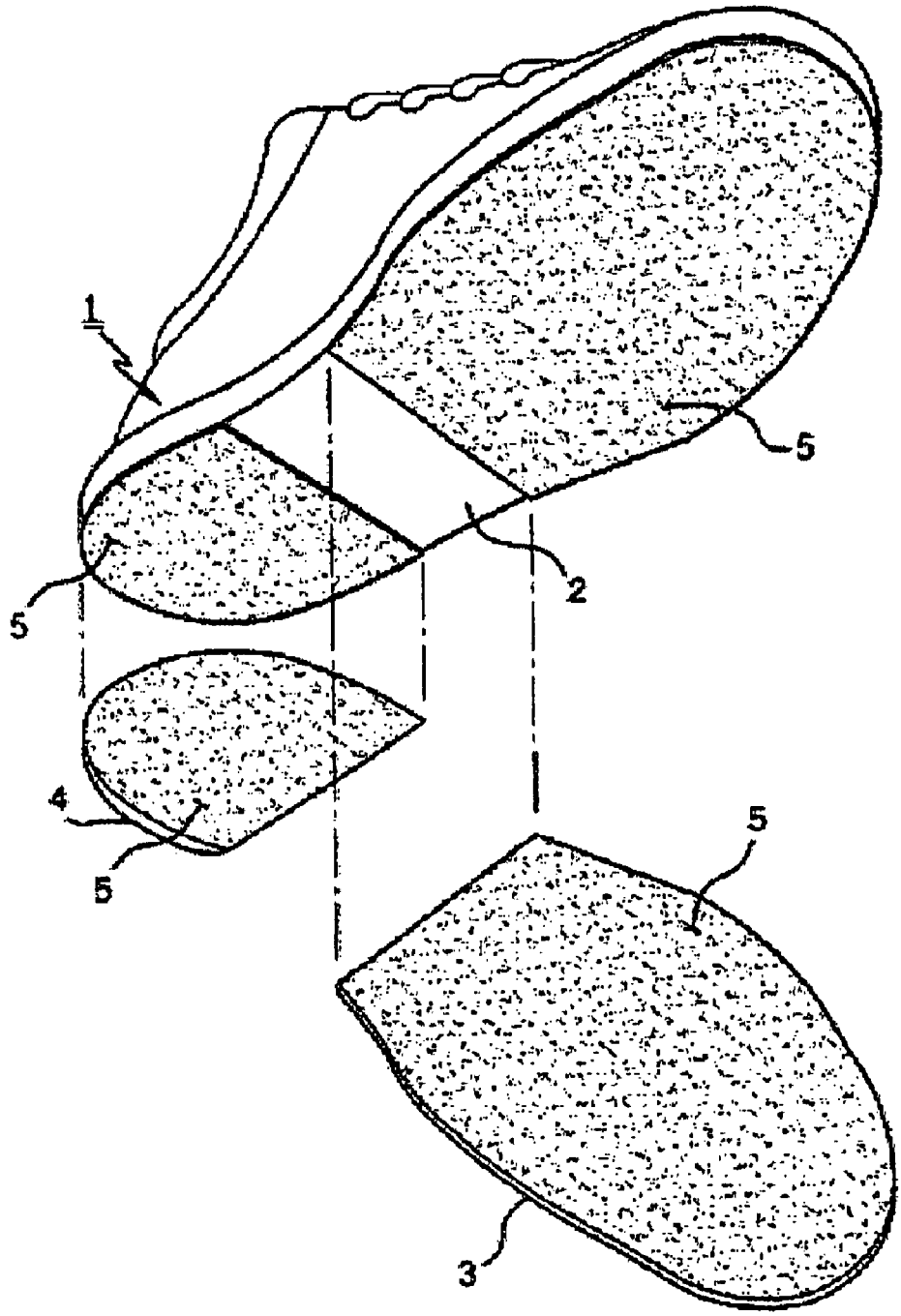
Fig. 1 (Prior Art)
FIGS. 1 and 2 are exploded perspective views each showing the bottom face of a sole for conventional bowling shoes.
Figure 2:
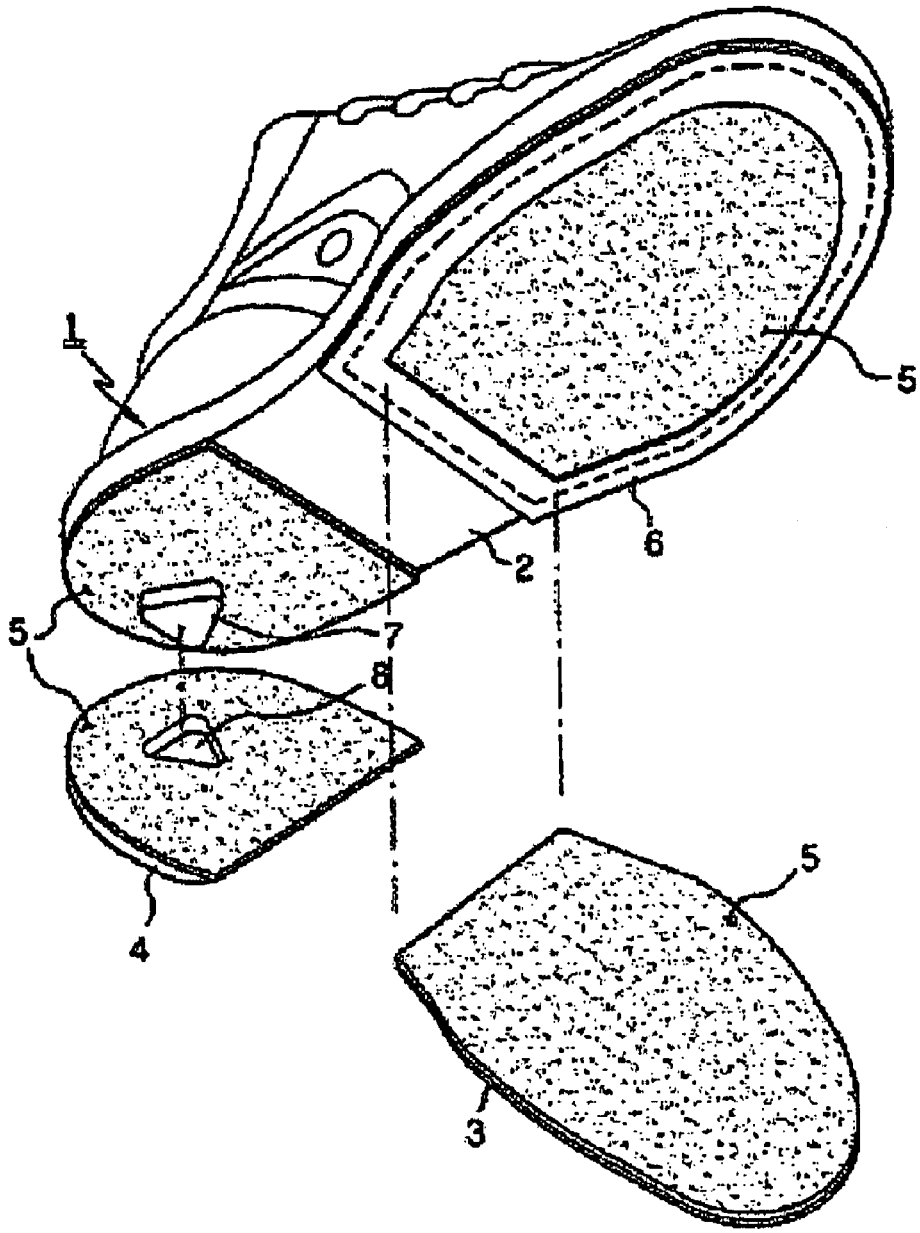
Fig. 2 (Prior Art)
Figure 3:
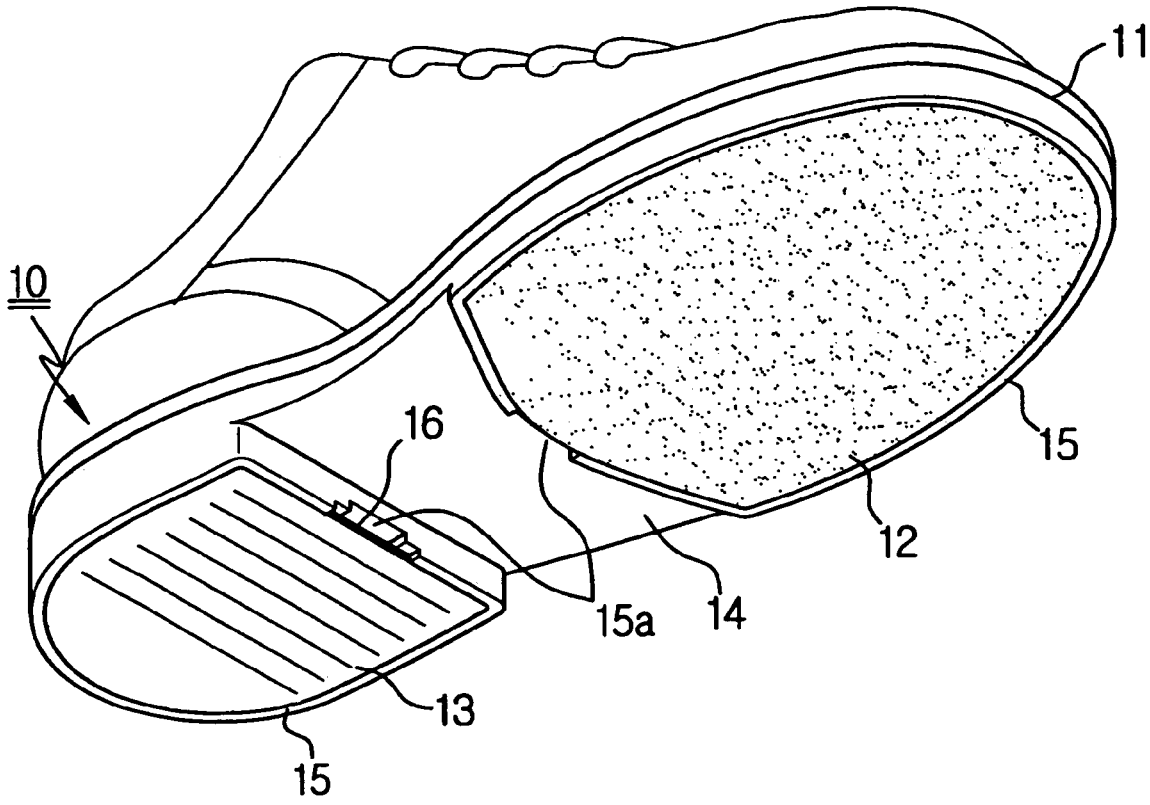
FIG. 3 is a perspective view showing the bottom face of a sole for bowling shoes according to an embodiment of the present invention.
Figure 4:
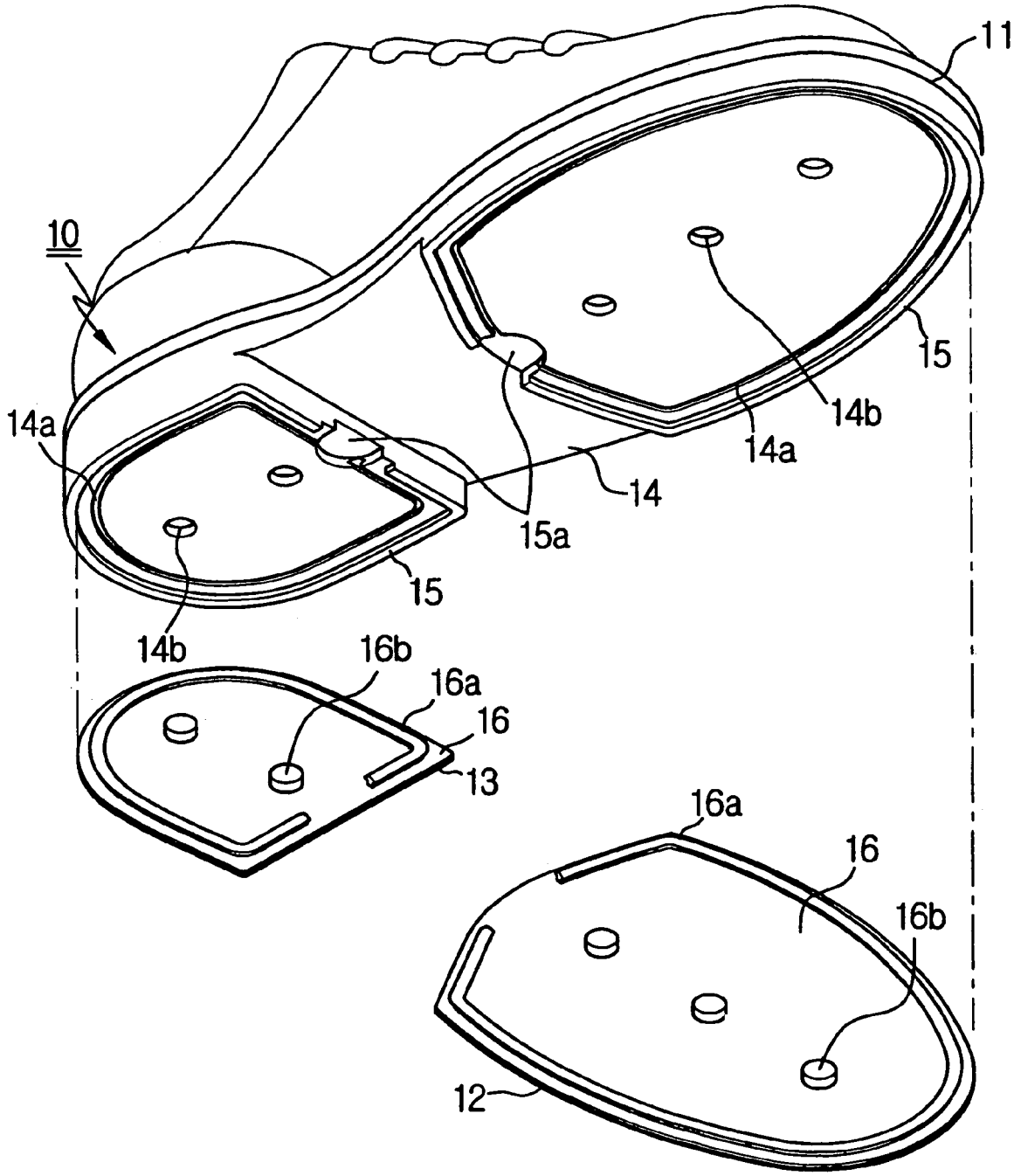
FIG. 4 is an exploded perspective view showing the bottom face of the sole for bowling shoes of FIG. 3.
Figure 5:
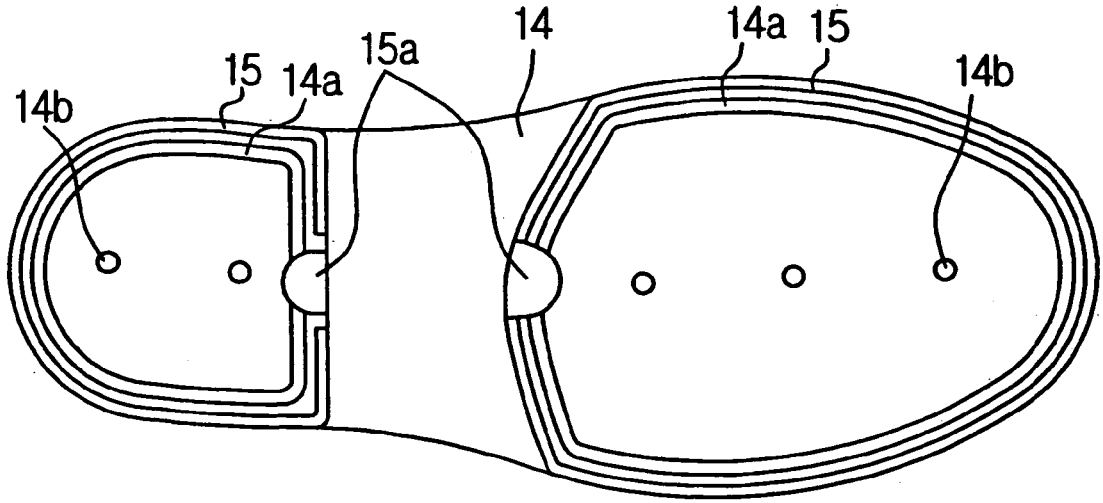
FIG. 5 is a bottom view of an example of the fixing plate of FIG. 3.
Figure 6:
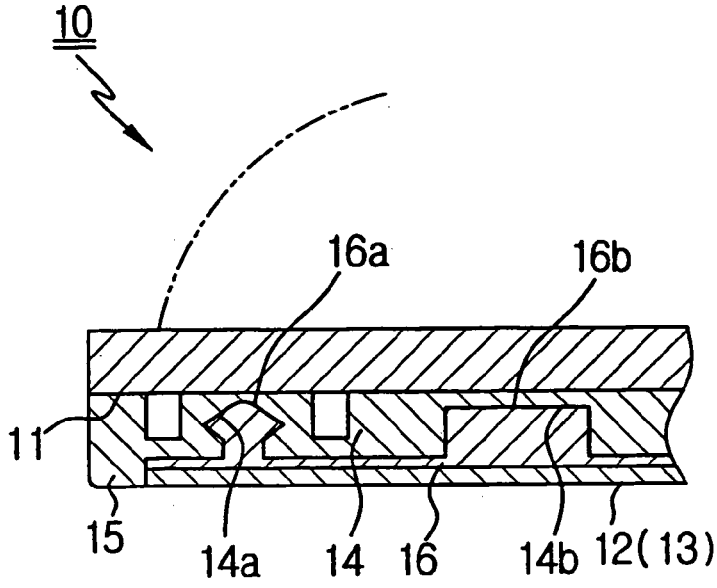
FIG. 6 is an enlarged sectional view of the principal parts of the present invention.

FIG. 3 is a perspective view showing the bottom face of a sole for bowling shoes according to an embodiment of the present invention, FIG. 4 is an exploded perspective view showing the bottom face of the sole for bowling shoes of FIG. 3, FIG. 5 is a bottom view of an example of the fixing plate of FIG. 3, and FIG. 6 is an enlarged sectional view of the principal parts of the present invention.

A sole 10 for bowling shoes according to the present invention is an improvement in the sole with a slip plate 12 detachably attached at the front portion of a bottom face 11 and with a heel part 13 detachably attached at the back portion of the bottom face 11. According to the present invention, a fixing plate 14 that is fixedly attached on the bottom face 11 is adapted to fix a separating plate 16 that is fixedly attached at the slip plate 12 and the heel part 13, respectively.

In other words, the fixing plate 14 that is fixedly attached to the bottom face 11 is provided with a protecting rim that is integrally formed therewith along the outside edge of each of the front and back portions of the bottom face 11. The fixing plate 14 has a coupling groove 14*a* formed along the outside edge thereof and a plurality of position adjusting holes 14*b* formed at the inside of the coupling groove 14*a*. And, each of the slip plate 12 and the heel part 13 to each of which the separating plate 16 is fixedly attached is detachably attached at the inside of the protecting rim 15, and in this case, the separating plate 16 has the same height as the protecting rim 15 at the state of being assembling with the protecting rim 15. The separating plate 16 has a coupling protrusion 16*a* formed thereon to be inserted into the coupling groove 14*a* of the fixing plate 14 and a plurality of coupling protrusions 16*b* formed at the inside of the coupling protrusion 16*a* to be inserted into the plurality of position adjusting holes 14*b* of the fixing plate 14.

Figure 7:
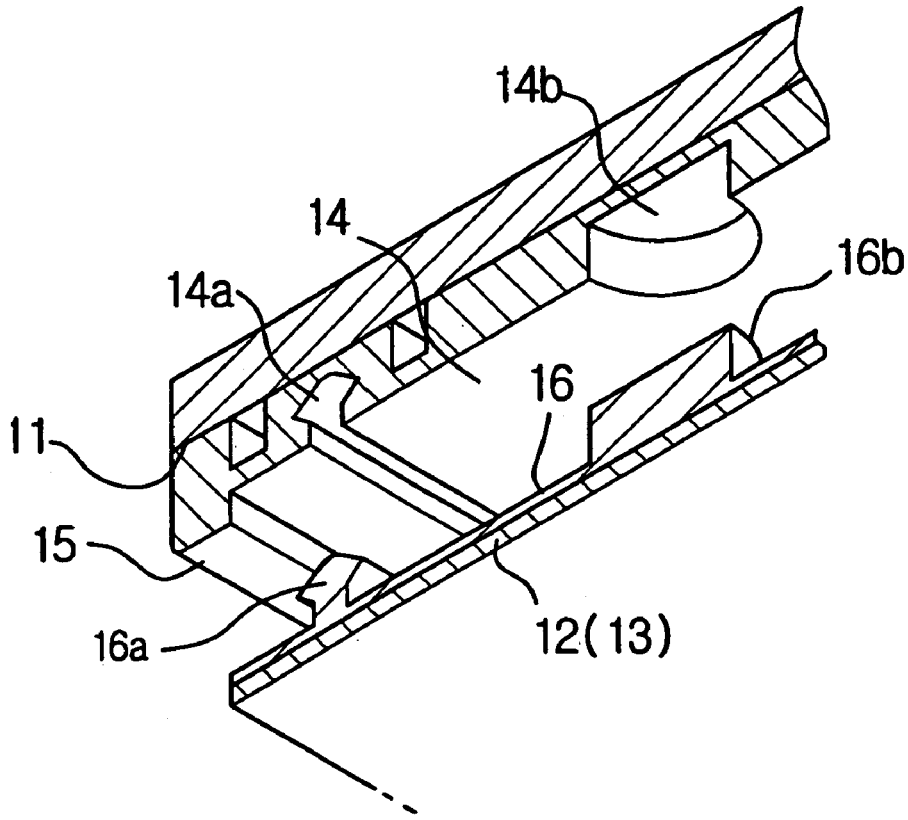
FIG. 7 is an exploded perspective view of FIG. 6.

At that time, the coupling groove 14*a* is narrow at the inlet thereof and becomes wide as it goes towards the upper portion thereof, and the coupling protrusion 16*a* is wide at the upper portion thereof and becomes narrow as it goes toward the lower portion thereof, such that when the coupling protrusion 16*a* is fit into the coupling groove 14*a*, the coupling groove 14*a* and the coupling protrusion 16*a* are not arbitrarily separated from each other, as shown in FIGS. 6 and 7.

The protecting rim 15 is provided with a separating groove 15*a* formed at one side thereof to easily separate each of the slip plate 12 and the heel part 13 from the fixing plate 14.

The separating grooves 15*a* are formed adjacent to the middle portion of the fixing plate 14, i.e., at the positions where the slip plate 12 and the heel part 13 face to each other, which does not give adverse influence to the external design of the shoe when viewed at the bottom face of the shoe.

The slip plate 12 and the heel part 13 are prepared by several pairs and thus selectively exchanged in accordance with the features of the bowling lanes.

Figure 10:
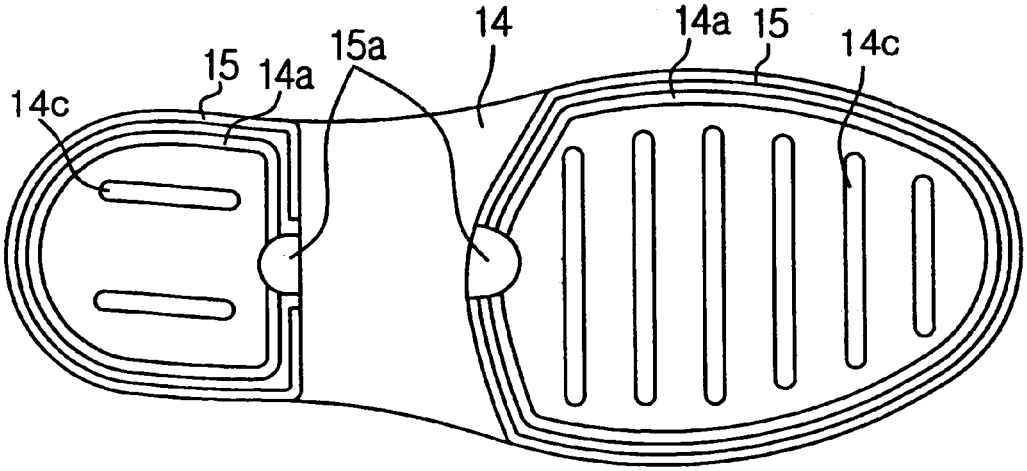
FIG. 10 is a bottom view of another example of the fixing plate of the present invention.

On the other hand, FIG. 10 is a bottom view of another example of the fixing plate of the present invention. The fixing plate 14 has the protecting rim 15 integrally formed therewith along the outside edge of each of the front and back portions of the bottom face 11, the curved coupling groove 14*a* formed at the inside of the protecting rim 15, and a plurality of coupling grooves 14*c* formed vertically or horizontally at the inside of the coupling groove 14*a* (At that time, of course, the separating plate 16 that is fixed at the slip plate 12 and the heel part 13, respectively is provided with the coupling protrusion 16*a* and the plurality of coupling protrusion 16*b* corresponding to the positions corresponding to the coupling groove 14*a* and the plurality of coupling grooves 14*c*).

Figure 11:
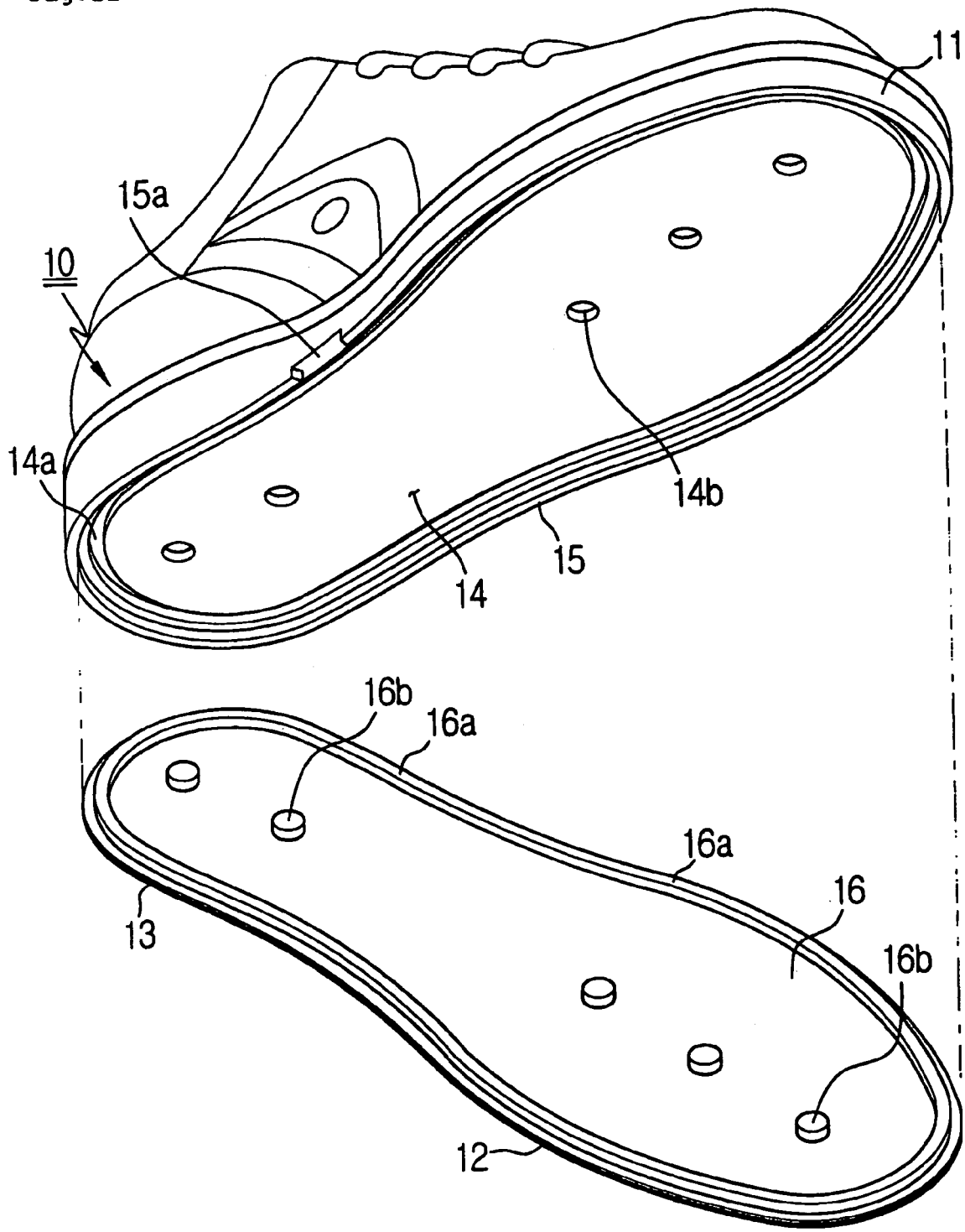
FIGS. 11 and 12 are exploded perspective views each showing the bottom face of a sole for bowling shoes according to another embodiment of the present invention.

FIG. 11 is an exploded perspective view showing the bottom face of a sole for bowling shoes according to another embodiment of the present invention. The fixing plate 14 is fixedly attached to the bottom face 11 of a sole, and has a continuous band-shaped protecting rim 15 formed along the outside edge of the bottom face 11 so that the slip plate 12 and the heel part 13 are received in a space defined by the fixing plate 14 and the band-shaped protecting rim 15. The fixing plate 14 has a coupling groove 14*a* formed along the outside edge thereof adjacent to the protecting rim 15 and a plurality of position adjusting holes 14*b* longitudinally formed thereon in a row. And, the slip plate 12 and the heel part 13 are formed as a unitary piece and are fixedly attached on the separating plate 16. The separating plate 16 is fit along the inner wall of the protecting rim 15. In this case, the bottom of the separating plate 16 is flush with that of the protecting rim 15 in a state where the separating plate 16 has been assembled with the protecting rim 15. The separating plate 16 has a coupling protrusion 16*a* formed along the outside edge thereof to be fit correspondingly into the coupling groove 14*a* of the fixing plate 14 and a plurality of coupling protrusions 16*b* longitudinally formed thereon in a row to be fit correspondingly into the plurality of position adjusting holes 14*b* of the fixing plate 14. The protecting rim 15 is provided with a separating groove 15*a* that is inwardly formed at one side thereof such that the separating groove 15*a* is not exposed to the outside when a Wearer wears the shoe.

Figure 12:
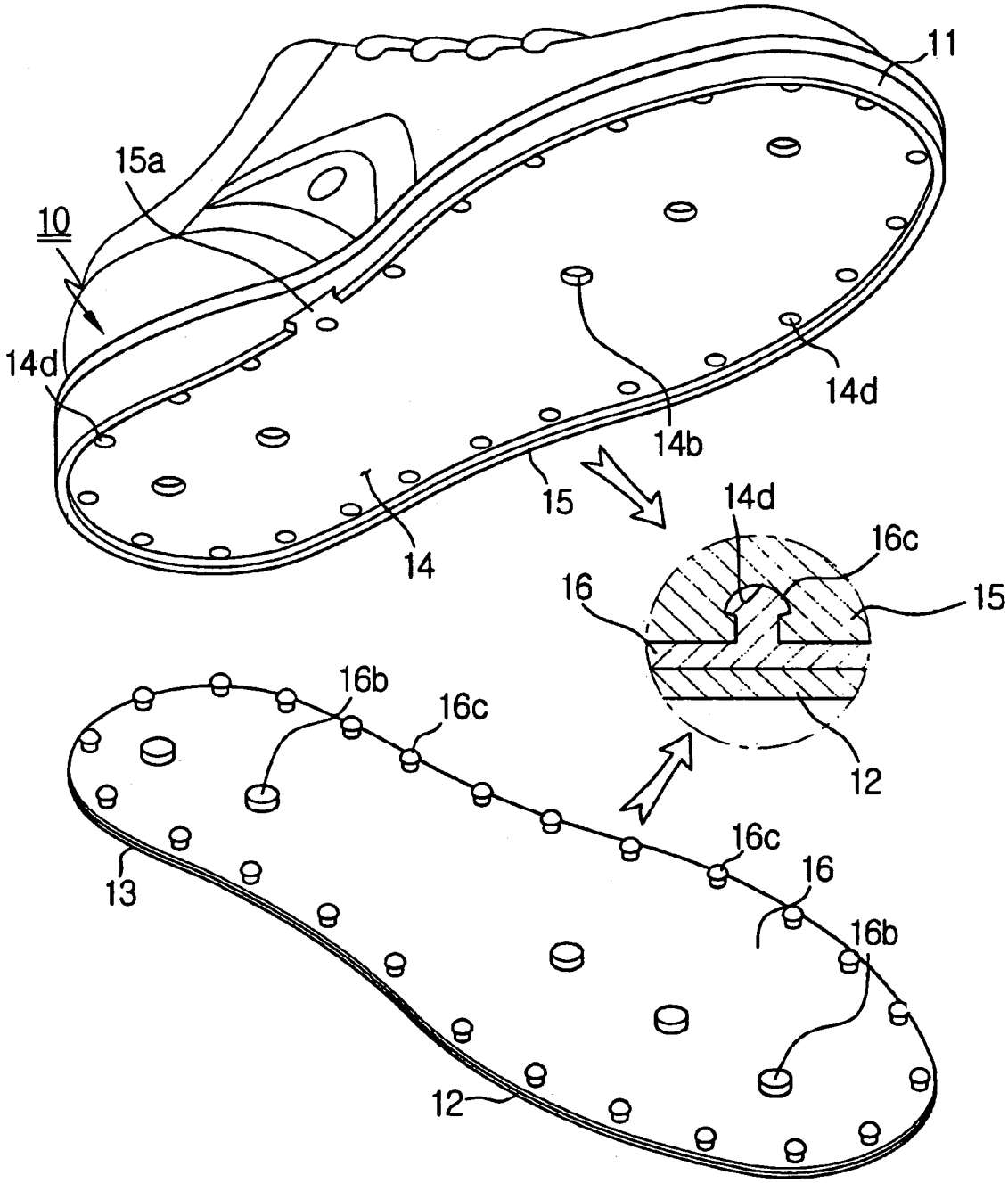

FIG. 12 is an exploded perspective view showing the bottom face of a sole for bowling shoes according to still another embodiment of the present invention. The fixing plate 14 has a plurality of coupling holes 14*d* along the outside edge thereof adjacent to the protecting rim 15 and a plurality of position adjusting holes 14*b* longitudinally formed thereon in a row. And, the slip plate 12 and the heel part 13 are formed as a unitary piece (or they are formed individually) and are fixedly attached on the separating plate 16. The separating plate 16 is fit along the inner wall of the protecting rim 15. In this case, the bottom of the separating plate 16 is flush with that of the protecting rim 15 in a state where the separating plate 16 has been assembled with the protecting rim 15. The separating plate 16 has a plurality of coupling protrusions 16*c* formed along the outside edge thereof to be snap-fit correspondingly into the plurality of coupling holes 14*d* of the fixing plate 14 and a plurality of coupling protrusions 16*b* longitudinally formed thereon in a row to be fit correspondingly into the plurality of position adjusting holes 14*b* of the fixing plate 14. The protecting rim 15 is provided with a separating groove 15*a* that is inwardly formed at one side thereof such that the separating groove 15*a* is not exposed to the outside when a wearer wears the shoe.

According to the sole 10 for bowling shoes as constructed above, when a wearer moves his or her step on the lane, good sliding is stably done on the left foot (or right foot) that moves forwardly at the last step.

That is, the fixing plate 14, which has the protecting rim 15 integrally formed therewith along the outside edge of each of the front and back portions of the bottom face 11, is attached on the bottom face 11, and the separating plate 16, which has the coupling protrusion 16*a* formed correspondingly to the coupling groove 14*a* of the fixing plate 14, is attached at the slip plate 12 and the heel part 13, respectively, such that the separating plate 16 is firmly fit into the fixing plate 14. In this construction, the slip plate 12 and the heel part 13 are detachably attached at the fixing plate 14 in an easier manner and are also kept fixed in more rigid manner.

According to the present invention, the coupling protrusion 16*a* of the separating plate 16 is structurally fit into the coupling groove 14*a* of the fixing plate 14, such that the slip plate 12 and the heel part 13 can be detachably attached in their right positions on the fixing plate 14 of the bottom face 11.

Figure 8:
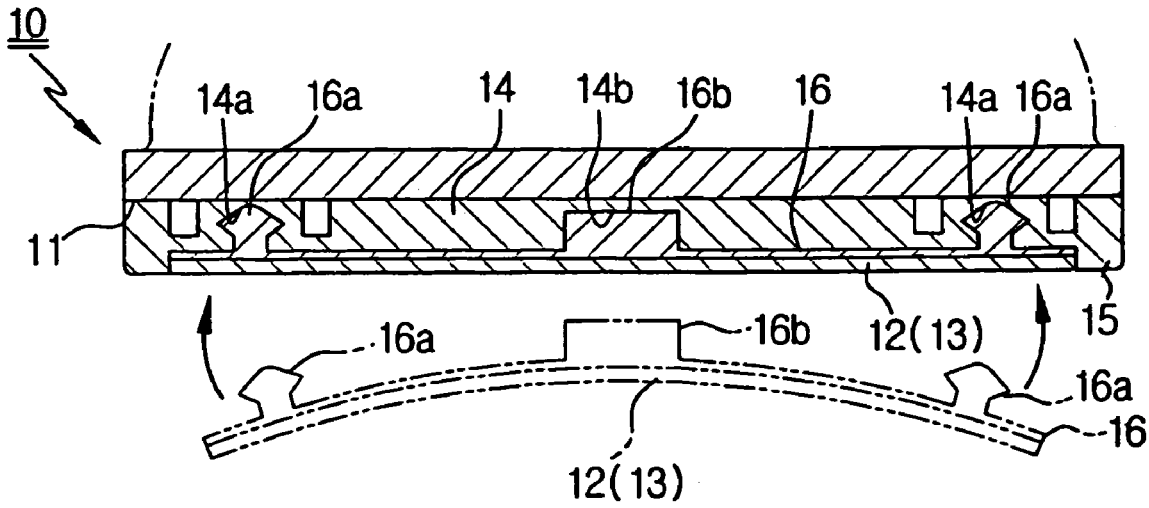
FIG. 8 is a sectional view showing the assembled example of a slip plate with a heel part according to the present invention.

That is, if the slip plate 12 and the heel part 13 are attached on the fixing plate 14, as shown in FIG. 8, the outside edge of each of the slip plate 12 and the heel part 13 is pressed to be bent and then, the coupling protrusions 16*b* on the separating plate 16 are fittingly inserted into the position adjusting holes 14*b* of the fixing plate 14. After that, if the outside edge of each of the slip plate 12 and the heel part 13 is pressed, the coupling protrusion 16*a* of the separating plate 16 is fit into the coupling groove 14*a* of the fixing plate 14 such that the slip plate 12 and the heel part 13 are rigidly coupled to each other.

In the coupling structure of the coupling groove 14*a* and the coupling protrusion 16*a*, as shown in FIG. 6, the coupling groove 14*a* is relatively narrow at the inlet thereof and becomes wide as it goes towards the upper portion thereof, and contrarily, the coupling protrusion 16*a* is wide at the upper portion thereof and becomes narrow as it goes toward the lower portion thereof, such that when the coupling protrusion 16*a* are fit into the coupling groove 14*a*, the slip plate 12 and the heel part 13 can maintain their coupling state in a more rigid manner.

Figure 9:
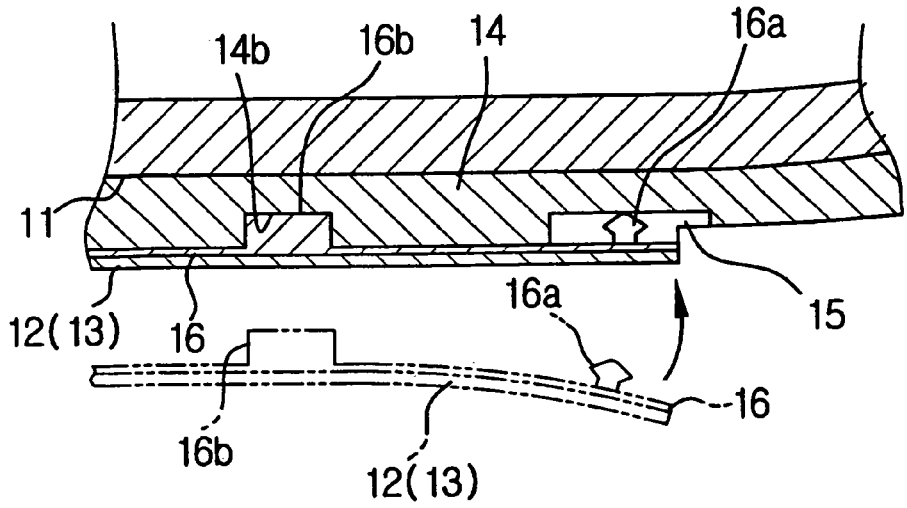
FIG. 9 is a sectional view showing the disassembled example of the slip plate with the heel part according to the present invention.

If the slip plate 12 and the heel part 13 are to be exchanged to another ones, as shown in FIG. 9, the shoe is turned over and a wearer's finger is inserted into the separating groove 15*a* of the protecting rim 15 of each of the slip plate 12 and the heel part 13 to pull the slip plate 12 and the heel part upwardly, such that they are easily separated from the fixing plate 14 and then exchanged. The exchange of them is carried out by the same manner as mentioned above.

In the meantime, when the sole for bowling shoes according to the present invention is constructed as in FIG. 11, the slip plate 12 and the heel part 13 formed as a unitary piece can be replaced at a time, thereby improving convenience in use.

Also, when the sole for bowling shoes according to the present invention is constructed as in FIG. 12, the coupling of the fixing plate 14 with the slip plate 12 and the heel part 13 can be firmly kept even though the bottom face of the sole is bent while a wearer walks.

It is to be noted that while the present invention has been described only focusing on the bowling shoes, it may be applied to a variety of kinds of shoes as constructed in FIG. 11.

As set forth in the foregoing, the sole 10 for bowling shoes according to the present invention is provided with the fixing plate 14 that is fixedly attached at the bottom face 11 and the separating plate 16 that is fixedly attached at the slip plate 12 and the heel part 13, wherein the coupling protrusion 16*a* of the separating plate 16 is fit into and coupled to the coupling groove 14*a* of the fixing plate 14. According to the present invention, the fixing plate 14 and the separating plate 16 that are fixedly attached at the bottom face 11 and the slip plate 12 and the heel part 13 are produced at low costs as they are made in an injection molding way, which removes the conventional problems in that additional fixing means like Velcro-fastener is provided, such that the fixing state is rigidly maintained just under the coupling relation between the coupling groove 14*a* of the fixing plate 14 and the coupling protrusion 16*a* of the separating plate 16. Additionally, the formations of the position adjusting holes 14*b* and/or the coupling holes 14*d* on the fixing plate 14 as well as the coupling protrusions 16*b* and/or 16*c* on the separating plate 16 enables the coupling process to be accomplished in a relatively short time period, which gives some practical advantages such as improvement of productivity efficiency, reduction of manufacturing cost, improved usage convenience, improvement of durability and so on.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A sole for bowling shoes in which a slip plate is detachably attached at the front portion of a bottom face of the sole and a heel part is detachably attached at the back portion of the bottom face of the sole, the sole for bowling shoes comprising;

a fixing plate having a protecting rim formed along the outside edge of each of the front and back portions of the bottom face of the sole, the fixing plate having a coupling groove formed inside of the protecting rim; and a separating plate attached at the slip plate and the heel part, respectively, wherein the separating plate has a coupling protrusion formed correspondingly to the coupling groove of the fixing plate such that the separating plate is fixed to the fixing plate with the coupling protrusion of the separating plate coupled to the coupling groove of the fixing plate without utilizing external fasteners for the coupling.

2. A sole for bowling shoes according to claim 1, wherein the protecting rim is a continuous band-shaped protecting rim which is formed along the outside edge of the fixing plate for receiving the slip plate and heel part in a space defined by the fixing plate and the band-shaped protecting rim, and the separating plate is fit along the inner wall of the protecting rim, the separating plate being formed as a unitary piece and having the slip plate and the heel part fixedly attached thereon as a unitary piece.

3. A sole for bowling shoes according to claim 1, wherein the coupling groove is narrow at the inlet thereof and becomes wide as it goes toward the upper portion thereof, and the coupling protrusion is wide at the upper portion thereof and becomes narrow as it goes toward the lower portion thereof, such that when the coupling protrusion is fit into the coupling groove, the coupling groove and the coupling protrusion are not arbitrarily separated from each other.

4. A sole for bowling shoes according to claim 1, wherein the fixing plate has a plurality of coupling holes along the outside edge thereof adjacent to the protecting rim and a plurality of position adjusting holes longitudinally formed thereon in a row, and the separating plate has a plurality of coupling protrusions formed along the outside edge thereof to be fit Correspondingly into the plurality of coupling holes of the fixing plate and a plurality of coupling protrusions longitudinally formed thereon in a row to be fit correspondingly into the plurality of position adjusting holes of the fixing plate.

5. A sole for bowling shoes according to claim 1, wherein the protecting rim has a separating groove formed at one side thereof to easily separate each of the slip plate and the heel part from the fixing plate.

* * * * *